US009259767B2

(12) United States Patent
Mueller et al.

(10) Patent No.: US 9,259,767 B2
(45) Date of Patent: Feb. 16, 2016

(54) DEVICE TO CLEAN A COMPONENT OF DEPOSITS

(71) Applicants: Andreas Mueller, Baldham (DE); Stefan Buschmann, Poing (DE); Robert Sigismund, Putzbrunn (DE); Rainer Schroeder, Poing (DE)

(72) Inventors: Andreas Mueller, Baldham (DE); Stefan Buschmann, Poing (DE); Robert Sigismund, Putzbrunn (DE); Rainer Schroeder, Poing (DE)

(73) Assignee: Oce Printing Systems GmbH, Poing (DE)

( * ) Notice: Subject to any disclaimer, the term of this patent is extended or adjusted under 35 U.S.C. 154(b) by 112 days.

(21) Appl. No.: 13/711,903

(22) Filed: Dec. 12, 2012

(65) Prior Publication Data

US 2013/0152979 A1 Jun. 20, 2013

(30) Foreign Application Priority Data

Dec. 20, 2011 (DE) ..... 10 2011 056 647

(51) Int. Cl.

| | |
|---|---|
| ***B08B 3/04*** | (2006.01) |
| ***B08B 3/02*** | (2006.01) |
| ***B08B 5/02*** | (2006.01) |
| ***B41J 2/165*** | (2006.01) |

(52) U.S. Cl.
CPC ... *B08B 3/04* (2013.01); *B08B 3/02* (2013.01); *B08B 5/02* (2013.01); *B41J 2/16538* (2013.01); *B41J 2/16541* (2013.01)

(58) Field of Classification Search
CPC ..... B08B 3/04; B08B 3/02; B08B 5/02; B41J 2/16541; B41J 2/16538
USPC ..... 134/94.1, 198; 438/754; 156/345.21
See application file for complete search history.

(56) References Cited

U.S. PATENT DOCUMENTS

| | | | | |
|---|---|---|---|---|
| 5,945,161 | A * | 8/1999 | Hashimoto et al. | 427/240 |
| 6,309,981 | B1 * | 10/2001 | Mayer et al. | 438/754 |
| 6,586,342 | B1 * | 7/2003 | Mayer et al. | 438/754 |
| 7,780,867 | B1 * | 8/2010 | Mayer et al. | 216/83 |
| 2002/0197944 | A1 * | 12/2002 | Inoue et al. | 451/444 |
| 2004/0036735 | A1 | 2/2004 | Garbacz et al. | |
| 2004/0206452 | A1 * | 10/2004 | Okuda et al. | 156/345.11 |
| 2008/0041423 | A1 * | 2/2008 | Hardikar et al. | 134/26 |
| 2008/0106571 | A1 | 5/2008 | Izawa et al. | |

FOREIGN PATENT DOCUMENTS

| | | |
|---|---|---|
| DE | 102006053241 | 5/2008 |
| EP | 0788882 | 7/2002 |
| EP | 1310367 | 5/2003 |
| EP | 1920931 | 5/2008 |
| JP | 2011161906 | 8/2011 |

* cited by examiner

*Primary Examiner* — Michael Barr
*Assistant Examiner* — Benjamin L Osterhout
(74) *Attorney, Agent, or Firm* — Schiff Hardin LLP

(57) ABSTRACT

In a device to clean a component of deposits, at least one first nozzle unit is positioned to spray a fluid at an angle onto a surface of the component that is to be cleaned, the first nozzle unit being provided opposite a border region of the surface of the component that is to be cleaned. At least one second nozzle unit generates a flow of a gaseous medium over the surface to be cleaned and is provided adjacent to edge of the border region of the surface of the component that is to be cleaned.

6 Claims, 9 Drawing Sheets

DEVICE TO CLEAN A COMPONENT OF DEPOSITS

BACKGROUND

Ink printing apparatuses can be used for single or multicolor printing of a printing substrate web, for example a single sheet or a belt shaped recording medium made of the most varied materials (for example paper). The design of such ink printing apparatuses is known, see for example EP 0 788 882 B1. Ink printing apparatuses that operate according to the drop-on-demand (DoD) principle, for example, have a print head or multiple print heads with nozzles comprising ink channels, the activators of which nozzles—controlled by a printer controller—excite ink droplets in the direction of the printing substrate web, which ink droplets are deflected onto said printing substrate web in order to apply printing dots there for a print image. The activators can generate ink droplets thermally (bubble jet) or piezoelectrically.

Given low print utilizations of the ink printing apparatus, not all nozzles of the inkjet print heads are activated in the printing process; many nozzles have downtimes (print pauses), with the consequence that the ink in the ink channel of these nozzles is not moved. Due to the effect of evaporation from the nozzle opening, the danger exists that the viscosity of the ink then varies. This has the consequence that the ink in the ink channel can no longer move optimally and escape from the nozzle. In extreme cases, the ink in the ink channel dries up completely and jams the ink channel, such that a printing with this nozzle is no longer possible.

These problems in particular occur in color printers. For example, here print bars with print heads are arranged in a fixed position relative to one another as a printing unit. For example, print bars with five respective print heads can be provided, respectively one print bar for the colors black, cyan, magenta, yellow. The problem exists that one or more colors are not used, for example in black-and-white printing. Multiple cleaning cycles are then required in order to make the unused print heads accessible again.

Cleaning devices that have cleaning lips (for example rubber lips) for cleaning of inkjet print heads are known. Such a cleaning device is described in US 2008/0106571 A1. The cleaning device provides two cleaning elements made up of a respective cleaning lip and a retaining element for said respective cleaning lip. A housing is provided for each cleaning element. Each cleaning element can be pivoted between two positions. In the first position—the cleaning position for the print heads—the cleaning elements are swung out of their respective housings so that the print heads can be directed over the cleaning lips. In the second position, the cleaning elements have been rotated into their respective housing. In this second position, the cleaning lips can be cleaned. For this, in each housing a nozzle is arranged that sprays a cleaning fluid onto the associated cleaning lip and therefore cleans the cleaning lip of ink residues. Furthermore, in each housing a second nozzle is provided at the level of the cleaning lip and perpendicular to the cleaning lip, which second nozzle sprays air onto the cleaning lip in order to dry it. The cleaning device can subsequently be pivoted into the first position again.

EP 1 310 367 A1 describes cleaning devices with cleaning lips with which the inkjet print heads can be wiped off. The cleaning devices are arranged in associated housings. They are borne on an axle via which the cleaning devices can be rotated out of the housing in order to be able to clean the print heads. If the cleaning devices are moved back into their housing, the cleaning lips are directed along a stripper in order to clean these.

SUMMARY

It is an object to specify a cleaning device for an apparatus (for example for an ink printing apparatus) via which components of the apparatus can be substantially completely cleaned of deposits (for example of ink residues).

In a device to clean a component of deposits, at least one first nozzle unit is positioned to spray a fluid at an angle onto a surface of the component that is to be cleaned, the first nozzle unit being provided opposite a border region of the surface of the component that is to be cleaned. At least one second nozzle unit generates a flow of a gaseous medium over the surface to be cleaned and is provided adjacent to an edge of the border region of the surface of the component that is to be cleaned.

DESCRIPTION OF PREFERRED EXEMPLARY EMBODIMENTS

Figure 1:
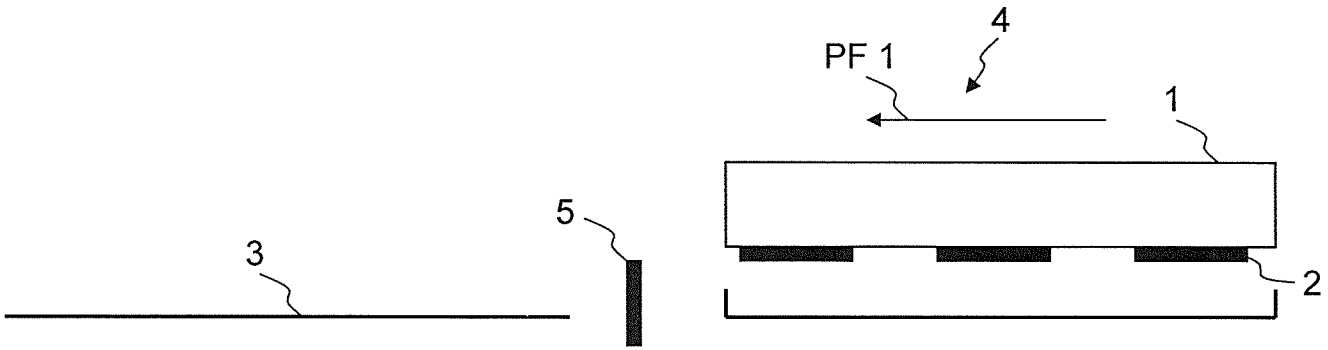
FIG. 1 is a principle representation of a printing unit with a print bar in a cleaning position.
Figure 2:
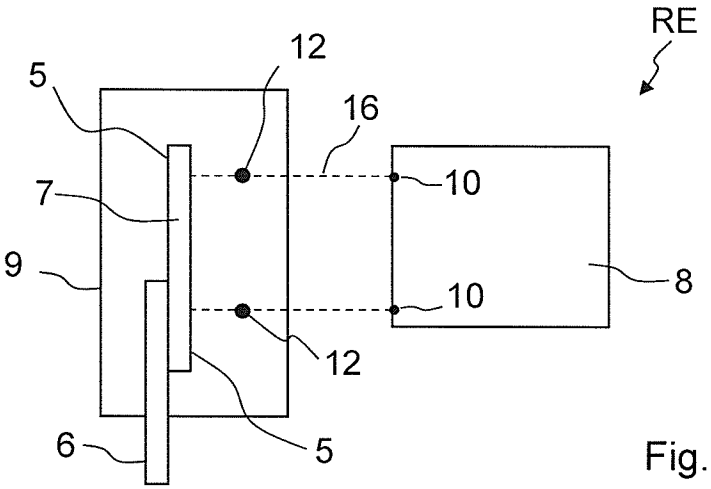
FIG. 2 is a principle representation of a cleaning device in front view.
Figure 3:
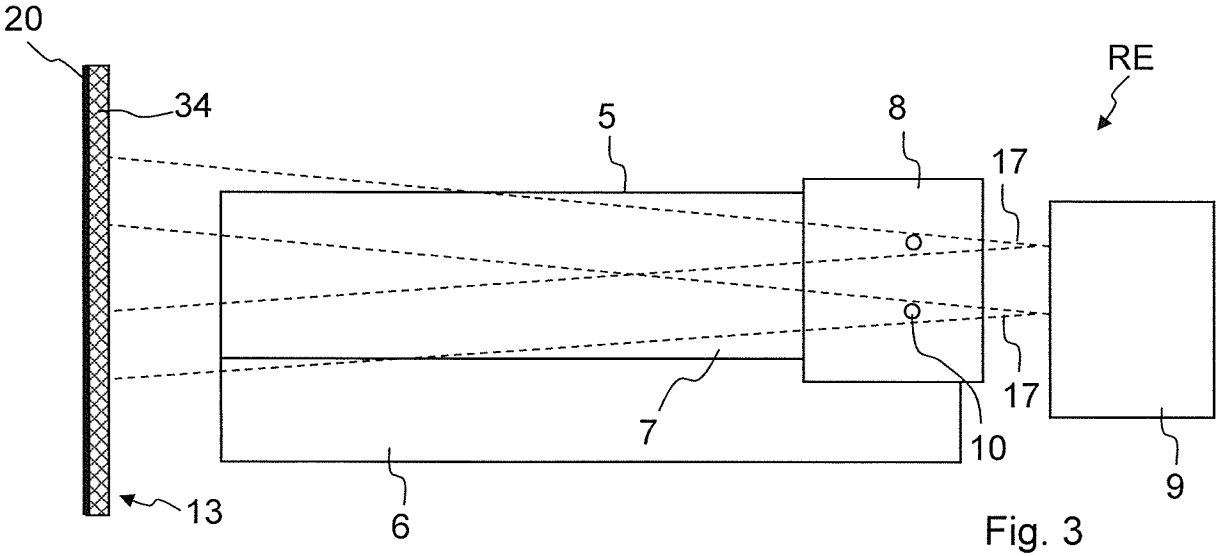
FIG. 3 is a further principle representation of the cleaning device according to FIG. 2, in side view.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included.

In the cleaning device, a first nozzle unit that sprays a fluid at an angle onto the surface of the component to be cleaned during a cleaning interval can be provided opposite a border region of the area of the component that is to be cleaned. To distribute the fluid over the area to be cleaned, a second nozzle unit that generates a flow of a gaseous medium along the area to be cleaned can be provided adjacent to the edge of the border region of the area of the component that is to be cleaned. The fluid can then act on deposits (ink residues, for example) on the area to be cleaned and can loosen these.

The second nozzle unit can furthermore generate a gaseous flow along the area to be cleaned in a drying interval following the cleaning interval, wherein the generated flow is adjusted and directed such that the mixture of fluid and the deposits loosened at the area to be cleaned are removed from the area to be cleaned, and the area to be cleaned is dried. The first nozzle unit can be deactivated in the drying interval.

To loosen deposits on the area of a component that is to be cleaned, a fluid can be sprayed onto the area to be cleaned. A gaseous medium that is placed under pressure is used to dry the area to be cleaned or to activate nozzles. In the following, in the explanation of the exemplary preferred embodiments air is used as a gaseous medium and a cleaning fluid (water, for example) is used as a fluid, without the exemplary preferred embodiments being limited to air or a cleaning fluid.

The cleaning device according to the exemplary preferred embodiments therefore has the following advantages:

by applying the cleaning fluid to only the border region of the area to be cleaned, the number of fluid nozzles can be reduced:

This measure leads to a cost reduction.

A smaller space demand is additionally required for the fluid nozzle unit.

Since only a few fluid nozzles must be operated, a smaller pump can be used in order to ensure the necessary pressure in the fluid nozzles.

Due to the lower applied quantity on the area to be cleaned and its distribution via the compressed air, the consumption of cleaning fluid is minimized.

Given contamination of one of a few (for example two) fluid nozzles, a cleaning effect is nevertheless provided due to the distribution of the cleaning fluid via the air. By using the additional fluid nozzles, a high reliability can therefore be ensured. In contrast to this, if the cleaning fluid is applied onto the area to be cleaned via many fluid nozzles without the cleaning fluid being distributed on the area to be cleaned via compressed air, the failure of one fluid nozzle has the effect that a partial segment of the area is no longer sufficiently cleaned.

In the following explanation of the preferred exemplary embodiments, an ink printing apparatus in which the cleaning of a cleaning lip (for example a rubber lip (wiper)) as a component to be cleaned should be implemented is used as an application example. However, the exemplary embodiments are not limited to this application case; it is always applicable if the surface of a component should be cleaned with the aid of a cleaning fluid and the area should possibly also be dried.

In principle, FIG. 1 shows the cleaning of the nozzles and nozzle surfaces of print heads 2 of a print bar 1 after these have, for example, been flushed with ink in a flushing station situated next to the printing substrate 3. Residues of ink thereby remain stuck to the nozzle surfaces. In a subsequent step, these residues must be removed from the nozzle surfaces. For example, for this the print bar 1 is directed (arrow PF1) past a cleaning element 5 (a rubber lip, for example), wherein the cleaning element 5 brushes along the print heads 2 and thereby strips off ink, for example. A relative movement between the print bar 1 and the cleaning element 5 is thereby implemented to clean the print heads 2, wherein the cleaning element 5 is directed past the print bar 1 or the print bar 1 is directed past the cleaning element 5. Since the cleaning element 5 is subsequently soiled with stripped-off ink (called ink residues in the following), it is necessary to wash and dry this with a cleaning fluid, for example.

In the following explanation of the exemplary embodiments with regard to FIGS. 2 through 8, the design of the cleaning device and the workflow of the cleaning is described using a cleaning element 5. The cleaning element 5 (for example a cleaning lip) attached to a carrier plate, the surface 7 of which cleaning element 5 should be cleaned, is used as a component to be cleaned.

Principle views of the cleaning device RE are shown in FIGS. 2 through 5. The cleaning device RE has a fluid nozzle unit 8 and an air nozzle unit 9. The fluid nozzle unit 8 is arranged relative to a border region 11 of the surface 7 of the cleaning element 5 that is to be cleaned, and has two fluid nozzles 10 (for example). The fluid nozzles 10 spray cleaning fluid at a cleaning interval onto the border region 11 of the surface 7 to be cleaned, for example onto the right border region 11 of the surface 7 to be cleaned (see FIG. 3). The air nozzle unit 9 is arranged adjacent to the edge 18 of the border region 11 of the surface 7 to be cleaned, such that air nozzles 12 (for example two air nozzles 12) blow air under pressure along the surface 7 to be cleaned, and thereby distribute the cleaning fluid across the surface 7 to be cleaned, wherein the ink residues and other deposits are washed off of the surface 7 to be cleaned. After the cleaning interval, the fluid nozzle unit 8 is deactivated, and in a drying interval only the air nozzle unit 9 is operated whose air nozzles 12 blow the air over the surface 7 to be cleaned, such that the air jets 17 remove the mixture of cleaning fluid and deposits from the surface 7 to be cleaned and dry the surface to be cleaned. The blown-off mixture can, for example, be deflected onto a capture unit 13 and can drain off there. The capture unit 13 can have a baffle 20, and a filter 34 before the baffle 20. An advantageous embodiment of the capture unit 13 can be learned from FIGS. 6 through 8.

Figure 4:
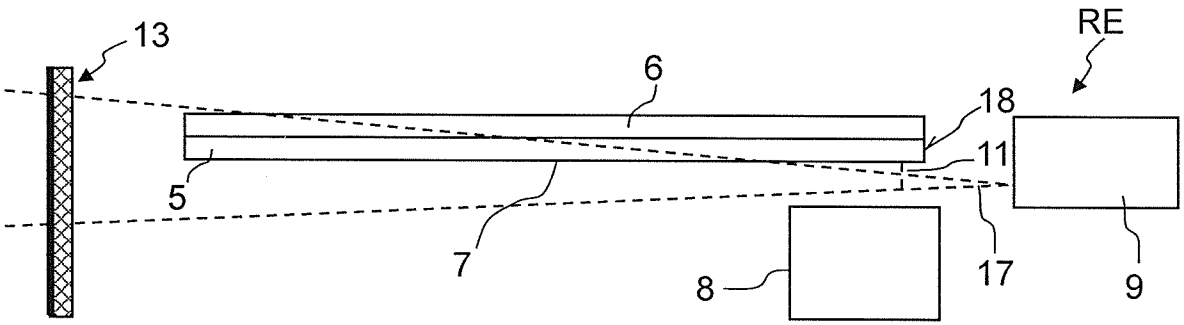
FIG. 4 is a principle representation of the cleaning device according to FIG. 2, in plan view.

FIG. 4 shows the cleaning device RE in plan view. The fluid nozzle unit 8 is arranged opposite the border region 11 of the surface 7 to be cleaned and sprays cleaning fluid onto the border region 11 of the surface 7 to be cleaned. The air nozzle unit 9 is arranged adjacent to the edge 18 of the border region 11 of the surface 7 to be cleaned and blows air along the surface 7 to be cleaned, wherein the cleaning fluid is distributed over the surface 7 to be cleaned in the cleaning interval. In the drying interval, only air is blown over the surface 7 to be cleaned, and therefore the mixture is transported on the surface 7 to be cleaned to the capture unit 13.

Figure 5:
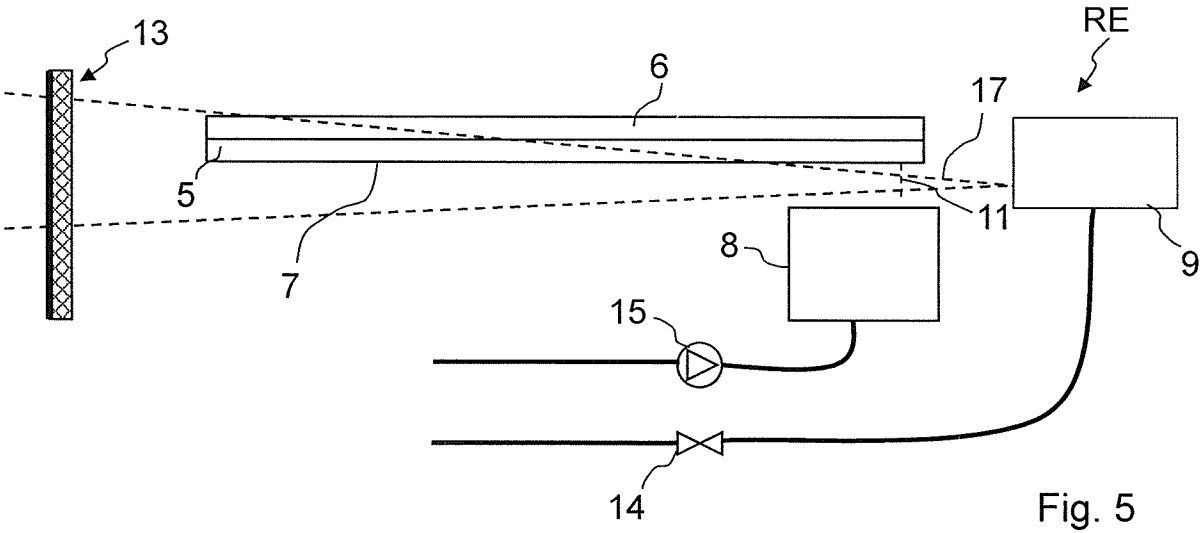
FIG. 5 is a presentation of the cleaning device according to FIG. 2 in plan view, with supply units.

In FIG. 5, the cleaning device RE has been supplemented with supply units. The air is supplied under pressure to the air nozzle unit 9 via a valve 14; the cleaning fluid is supplied via a pump 15 to the fluid nozzle unit 8. The fluid nozzles 10 and the fluid jets 16 emitted by them are aligned so that they strike in the border region 11 (for example 3 mm behind the edge 18 of the surface 7 to be cleaned) only on one side of the cleaning element 5. Depending on the surface 7 to be cleaned (for example its height), one or more fluid nozzles 10 can be used; for example, two fluid nozzles 10 arranged closely adjacent to one another can be provided. Since the surface 7 to be cleaned should be wetted with cleaning fluid over the entire width for a good cleaning, compressed air from the air nozzles 12 is used to distribute the cg over the entire width of the surface 7 to be cleaned. This means that the cleaning fluid is activated continuously in the cleaning interval, and the compressed air is activated simultaneously or shortly afterward. The cleaning fluid is hereby blown over the surface 7 to be cleaned and then wets the entire surface 7 to be cleaned. This method produces a good cleaning of the surface 7 to be cleaned given the use of a small quantity of cleaning fluid. The fluid nozzles 10 are deactivated after the surface 7 to be cleaned has been completely wetted. In the drying interval, the compressed air (also called drying air in the following) is subsequently activated. The air nozzles 12 blow the mixture of cleaning fluid and deposits off of the surface 7 to be cleaned and dry this.

For an optimal use of the cleaning device RE, it is important that the cleaning fluid strikes the surface 7 to be cleaned and has not previously been blown by the compressed air from the air nozzles 12. The fluid jets 16 and the air jets 17 are therefore matched to one another.

The strength of the compressed air that distributes the cleaning fluid over the surface 7 to be cleaned, and the strength of the compressed air that is used to dry the surface 7 to be cleaned, can be set differently.

The compressed air can be used in pulses in the cleaning interval, for example activated for 10 ms, deactivated for 50 ms.

The cleaning fluid can strike the surface 7 to be cleaned at an arbitrary angle.

An angle of 90° is preferred.

The air nozzles 12 should be arranged in parallel with or at a slight angle to the surface 7 to be cleaned in order to achieve a good distribution of the cleaning fluid.

In order to prevent a contamination of neighboring components or of the environment of the surface 7 to be cleaned, it is reasonable to provide a capture unit 13 for the mixture of cleaning fluid and deposits removed from the surface 7 to be cleaned, which capture unit 13 is arranged after the surface 7 to be cleaned (as viewed in the blowing direction of the drying area). One embodiment of the capture unit 13 can be learned from FIGS. 6 through 8. FIG. 6 again shows the cleaning device RE in a perspective view. The air nozzle unit 9 that has the air nozzles 12 is arranged to the side of the edge 18 of the surface 7 to be cleaned. The fluid nozzle unit 8 with the fluid nozzles 10 is provided opposite the border region 11 of the surface 7 to be cleaned. In the cleaning interval, the cleaning fluid is sprayed with the fluid nozzles 10 onto the border region 11 of the surface 7 to be cleaned; and the distribution of the cleaning fluid takes place via the compressed air blown by the air nozzles 12 along the surface 7 to be cleaned. After the cleaning fluid has wetted the surface 7 to be cleaned and has loosened deposits on the surface 7 to be cleaned, the fluid nozzles 10 are deactivated, and only the air nozzles 12 are still activated in the drying interval. The mixture of cleaning fluid and deposits that is arranged, distributed on the surface 7 to be cleaned, is therefore blown towards the capture unit 13 and collected there.

Figure 7:
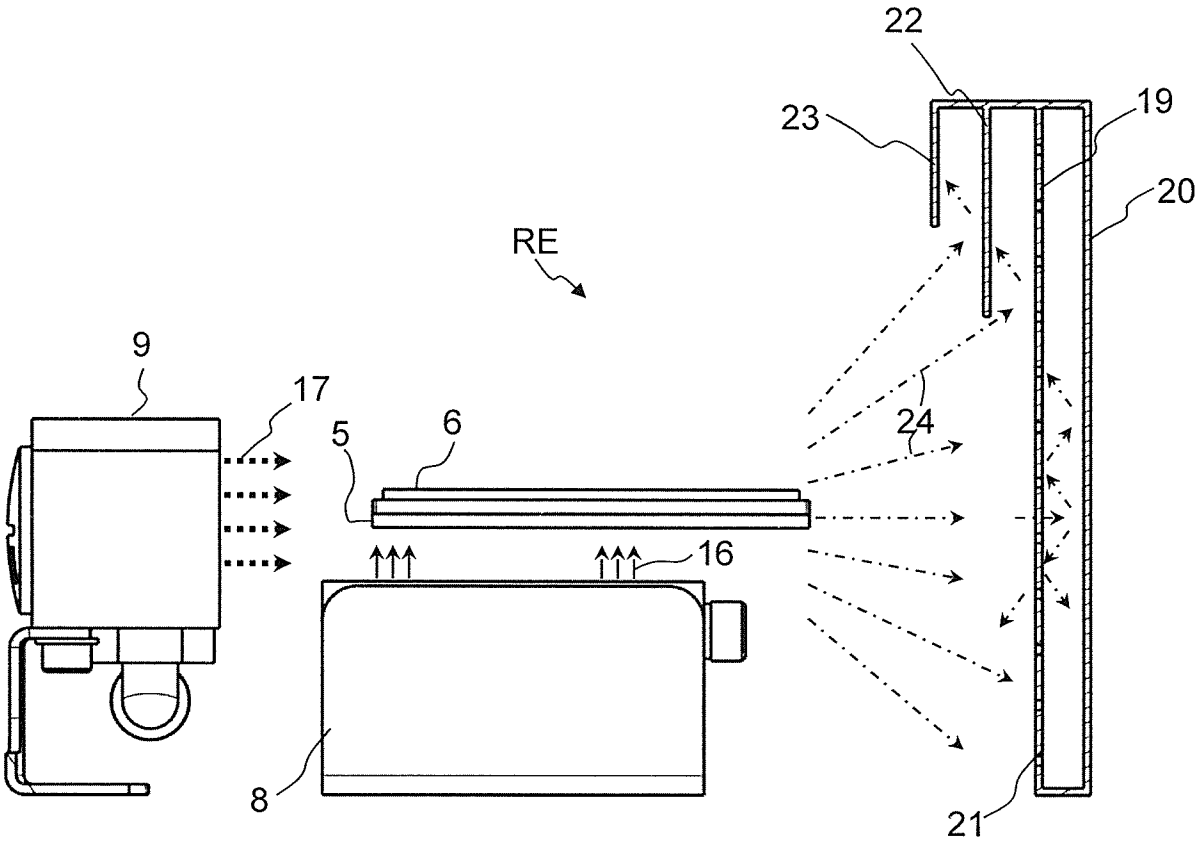
FIG. 7 shows the cleaning device according to FIG. 6 in side view, with the capture unit in section presentation.

The design of the capture unit 13 can be learned from the presentation according to FIG. 7. Shown in FIG. 7 is the cleaning device RE in side view, wherein only the capture unit 13 is shown in section. The capture unit 13 has a perforated plate 19 (a perforated baffle 19, for example) arranged adjacent to the surface 7 to be cleaned, which perforated plate 19 is inserted into a deflecting plate 20 (for example an impact baffle 20) and with this forms an encapsulated region 21. The deflecting plate 20 can have at least one strip 22 curved downward (for example a labyrinth 22 directed downward) facing towards the surface 7 to be cleaned, which strip 22 partially covers the perforated plate 19. The deflecting plate 29 can additionally have a second strip 23 curved downward that partially overlaps the first labyrinth and forms a second labyrinth 23 situated parallel to the first labyrinth 22.

In the drying interval, the surface 7 to be cleaned that is wetted with cleaning fluid in the cleaning interval (represented by fluid jets 16) is blown with drying air (indicated by dotted air jets 17) so that the mixture of cleaning fluid and deposits (indicated by dash-dot mixture jets 24) strikes the perforated plate 19 and is deflected upward and downward in part via this. The mixture proportion traveling through the perforated plate 19 strikes the deflector plate 20 and is likewise deflected. By striking the perforated plate 19 or the deflector plate 20, the deflected mixture portions lose their kinetic energy and—due to gravity—collect below at the floor of the capture unit 13. An upward distribution of sprays of the mixture that ricochet at the perforated plate 19 or the labyrinth 22 is prevented by the labyrinths 22 or 23.

Figure 6:
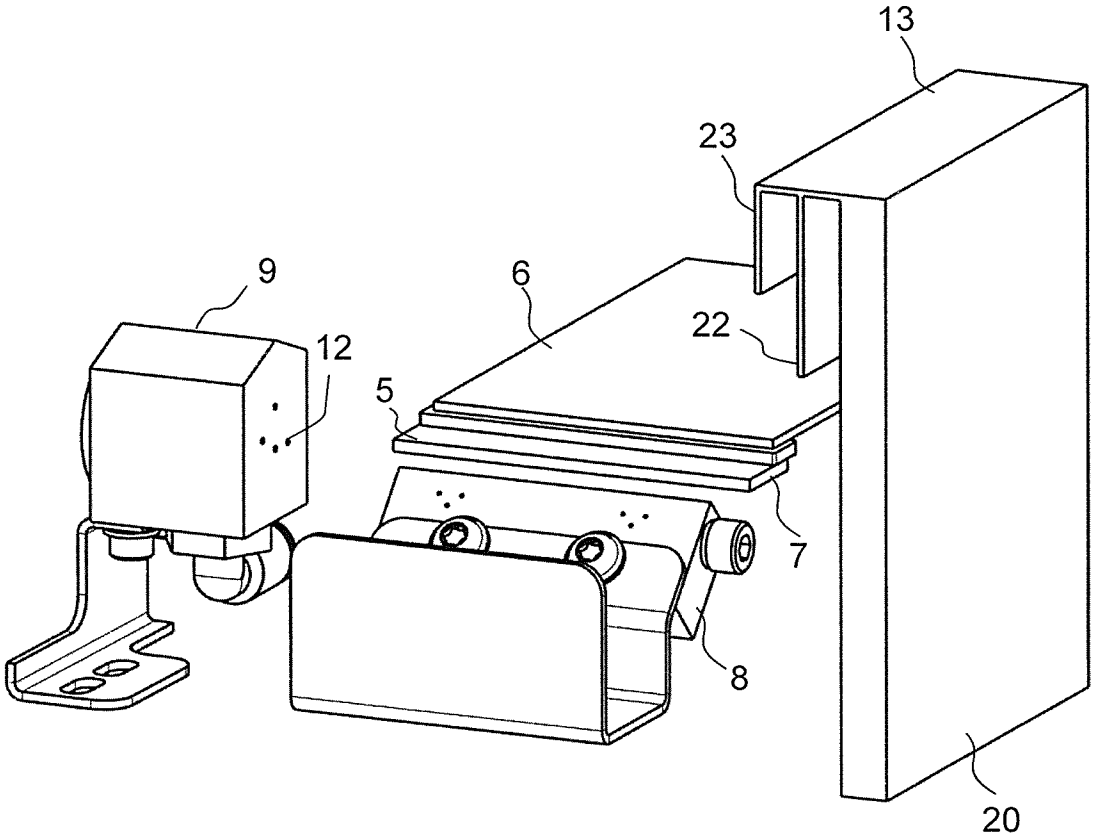
FIG. 6 is a perspective view of the cleaning device according to FIG. 2, with an embodiment of a capture unit for the mixture of cleaning fluid and deposits loosened from the area to be cleaned.
Figure 8:
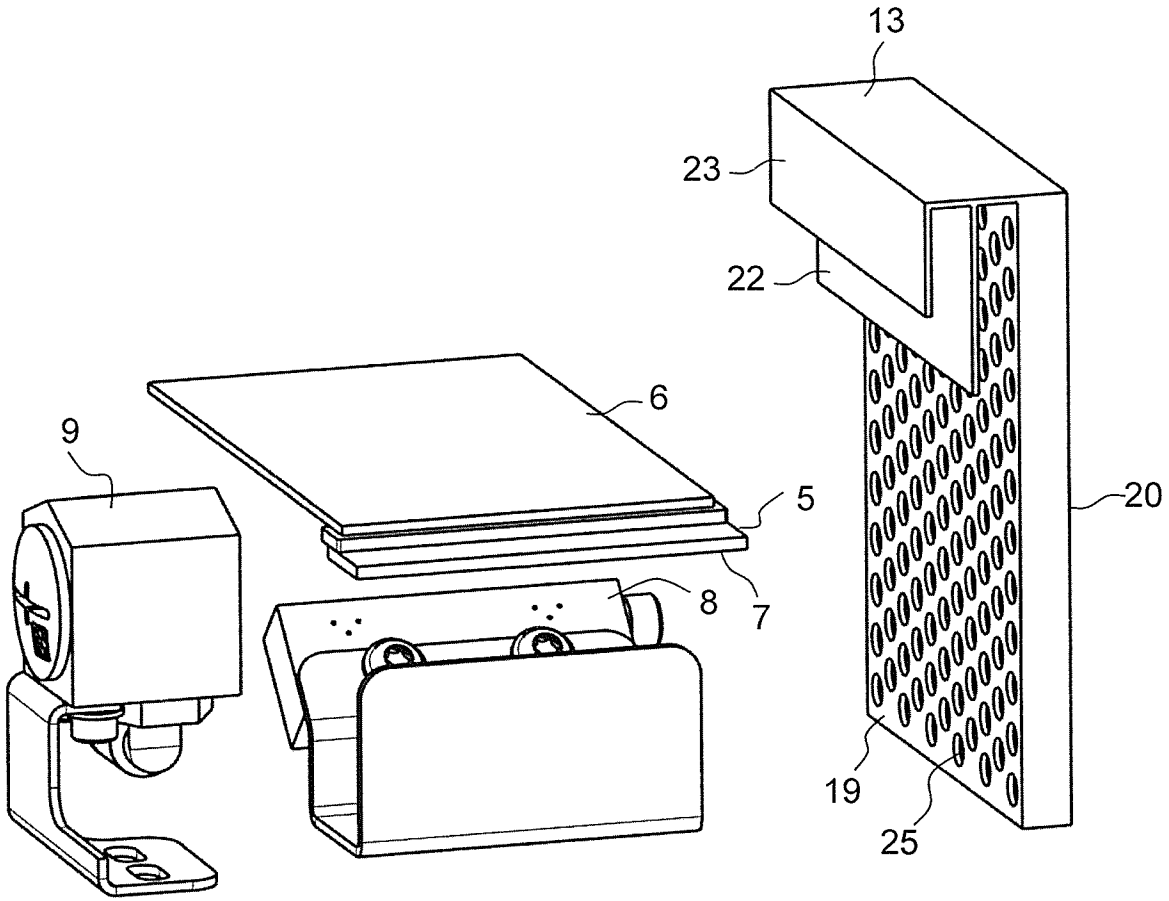
FIG. 8 is a perspective representation of the cleaning device according to FIG. 6 from a different viewing direction.

In comparison to FIG. 8, FIG. 6 shows the cleaning device RE in a perspective view in a different viewing direction in order to depict the realization of the perforated plate 19. The diameter of the holes 25 of the perforated plate 19 is selected such that the mixture jets 24 can travel through the holes 25 in order to strike the deflector plate 20; and thus a scattering of mixture portions out of the space 21 due to the perforated plate 19 is avoided. The remaining design of the cleaning device RE corresponds to FIG. 6.

Figure 9:
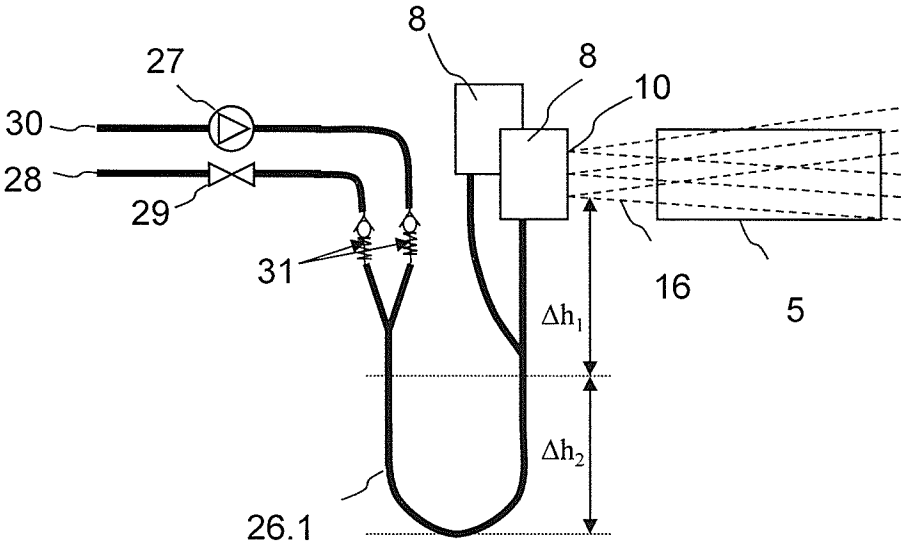
FIG. 9 through FIG. 11 are embodiments of a fluid nozzle unit with supply units.
Figure 10:
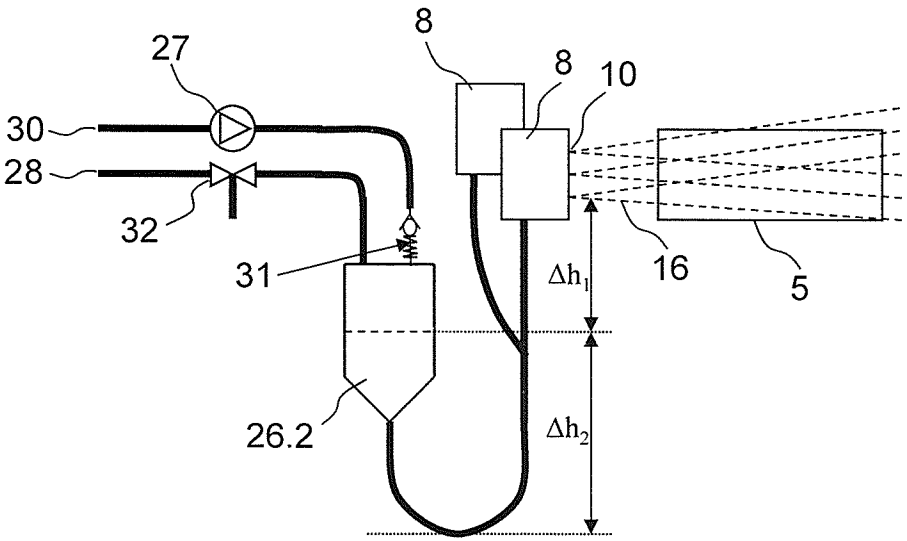
Figure 11:
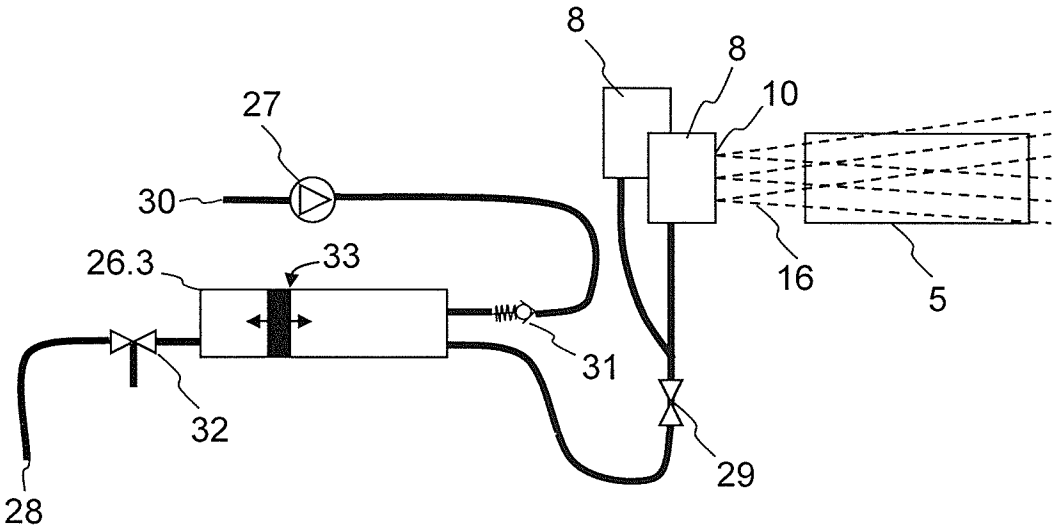

A supply unit for a fluid nozzle unit 8 can be learned from FIGS. 9 through 11. The supply unit has a storage 26 in which the cleaning fluid is stored, and a fluid nozzle unit 8 with at least one fluid nozzle 10. The cleaning fluid is transported via a pump 27 from the fluid connector 30 into the storage 26. During this time the supply unit is connected to atmosphere without pressure. If the storage 26 is filled, the pump 27 is deactivated. In the cleaning interval, compressed air (i.e. an overpressure) is provided via a compressed air connection 28 to the storage 26. The cleaning fluid is hereby driven at high pressure and high velocity out of the fluid nozzle 10 and is sprayed onto the surface 7 of the component that is to be cleaned. The compressed air is deactivated with the end of the cleaning interval, for example after emptying of the storage 26. The supply unit can have additional elements. For example, a valve 29 with which the compressed air can be interrupted can be inserted into the compressed air connector 28. Or, a return valve 31 can be inserted into the feed line 30 for the cleaning fluid or the feed line 28 for the compressed air in order to prevent that the cleaning fluid can unintentionally arrive from the storage 26 at the input to the supply unit.

FIG. 9 shows a first embodiment of a storage 26 in the supply unit. Here a hose system 26.1 (for example a hose loop) that is arranged below the lowermost fluid nozzle 10 is used as a storage 26 in order to prevent that the cleaning fluid can unintentionally escape from the fluid nozzles 10. For example, the storage 26.1 can be arranged below the lowermost fluid nozzle 10 such that its fill level $\Delta h_2$ lies $\Delta h_1$ below the lowermost fluid nozzle 10.

In a third embodiment (FIG. 11), the storage 26 is realized as a cylinder 26.3 with piston 33. By moving the piston 33, cleaning fluid can be pushed to the fluid nozzle unit 8 or be accepted into the cylinder 33 via the pump 27; and compressed air can be supplied to the cylinder 26.3 via a 3/2 valve. Here the cleaning fluid and the compressed air are completely separate from one another.

The embodiments according to FIGS. 9 through 11 have the following advantages:

The quantity of cleaning fluid that is to be expelled can be adjusted via variation of the storage size or via adaptation of the pump running time or the valve opening duration.

The pump 27 is used only to fill the storage 26. The pump 27 can therefore be small and cost-effectively dimensioned. The cleaning fluid is subsequently fired out of the fluid nozzle 10 via overpressure.

By using compressed air for transport of the cleaning fluid, a high pressure can be achieved at the fluid nozzles 10, and therefore a high exit velocity of the cleaning fluid can be achieved at the fluid nozzles 10, which enables an improvement of the cleaning effect. The cleaning fluid ejected via compressed air can strike the surface 7 to be cleaned with higher pressure in comparison to the use of a pump.

The mechanism effect of the cleaning fluid that is required for the cleaning process can be regulated and adjusted via the air pressure. Given a change of the cleaning fluid, the cleaning device RE can be adapted by varying the pressure.

The cleaning device RE can be adjusted depending on the shape of the fluid nozzles 10 and the exerted pressure to fire a jet or an aerosol.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. An ink head cleaning system, comprising:

a cleaning device and an ink residue cleaning element;

said ink residue cleaning element removing ink residues from a print head, said cleaning element having an edge with an adjacent border region where the removed ink residues are collected, said border region being part of and located at one end of a surface to be cleaned on the cleaning element, said cleaning element having another end opposite said one end;

said cleaning device comprising a fluid spray nozzle directing a fluid spray during a cleaning interval in a first direction onto said border region of the cleaning element adjacent said edge;

said cleaning device further comprising a gaseous medium flow nozzle directing a gaseous medium flow in a second direction substantially different than said first direction substantially toward but above said edge and onto and across said border region to blow the cleaning fluid and collected ink residues from said border region across remaining portions of said surface adjacent said border region to be cleaned such that a mixture of said cleaning fluid with said collected ink residues exits said surface to be cleaned at said another end of said surface to be cleaned opposite said one end; and said cleaning device further comprising a capturing unit arranged after said surface to be cleaned as viewed in a flow direction of a gaseous medium flow for collecting said mixture of said ink residues and cleaning fluid exiting at said another end.

2. The cleaning system of claim 1 in which the capture unit has a perforated plate at which the mixture strikes, and the perforated plate having holes of such a size that at least a portion of the mixture passes through the holes.

3. The cleaning system according to claim 2 in which a deflection plate is provided with which the perforated plate forms a container, and the deflection plate is positioned such that the mixture portion passing through the perforated plate strikes the deflection plate.

4. The cleaning system according to claim 3 in which the container has at least one end at which is located at least one first strip spaced at a distance from the perforated plate, said first strip being designed such that portions of said mixture rebounding from the perforated plate strike the first strip.

5. The cleaning system according to claim 4 in which a second, more narrow strip is provided adjacent and parallel to the first strip, said second strip partially overlapping the first strip and being designed such that mixture portions rebounding from the first strip strike the second strip.

6. The cleaning system according to claim 1 in which the fluid spray nozzle is arranged relative to the surface to be cleaned such that the fluid spray strikes the surface to be cleaned at an angle of substantially 90°.

* * * * *